US008876492B2

(12) United States Patent
Ulrey et al.

(10) Patent No.: US 8,876,492 B2
(45) Date of Patent: Nov. 4, 2014

(54) METHOD AND SYSTEM FOR OPERATING AN EJECTOR

(75) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 625 days.

(21) Appl. No.: 13/050,632

(22) Filed: Mar. 17, 2011

(65) Prior Publication Data

US 2012/0237365 A1 Sep. 20, 2012

(51) Int. Cl.
*F04F 5/20* (2006.01)
*F04F 5/54* (2006.01)

(52) U.S. Cl.
CPC .... *F04F 5/20* (2013.01); *F04F 5/54* (2013.01)
USPC ..... 417/80; 417/79; 417/151; 417/158

(58) Field of Classification Search
USPC ..... 417/79, 80, 151, 158, 159; 123/198 C
See application file for complete search history.

(56) References Cited

U.S. PATENT DOCUMENTS 5,611,204 A 3/1997 Radovanovic et al.
6,817,837 B2 * 11/2004 Hutchinson et al. ..... 417/77
6,880,534 B2 * 4/2005 Yoshiki et al. ..... 123/520
7,076,952 B1 7/2006 Vetrovec
7,650,221 B2 1/2010 Oi et al.
2008/0103667 A1 * 5/2008 Suzuki et al. ..... 701/70
2011/0176931 A1 7/2011 Pursifull

OTHER PUBLICATIONS

Cunningham, Ralph Wayne et al., "A Method for Purging Fuel Vapors" U.S. Appl. No. 12/838,700, filed Jul. 19, 2010, 37 pages.
Karnik, Amey Y. et al., "Engine Vacuum System" U.S. Appl. No. 13/050,647, filed Mar. 17, 2011, 32 pages.
Cunningham, Ralph Wayne et al., "Method and System for Providing Vacuum" U.S. Appl. No. 13/050,664, filed Mar. 17, 2011, 44 pages.
Pursifull, Ross Dykstra et al., "Method and System for Prioritizing Vehicle Vacuum" U.S. Appl. No. 13/050,700, filed Mar. 17, 2011, 40 pages.
Pursifull, Ross Dykstra et al., "Method and System for Providing Vacuum Via Excess Boost" U.S. Appl. No. 13/050,683, filed Mar. 17, 2011, 46 pages.

* cited by examiner

*Primary Examiner* — Charles Freay
*Assistant Examiner* — Philip Stimpert
(74) *Attorney, Agent, or Firm* — Julia Voutyras; Alleman Hall McCoy Russell & Tuttle LLP

(57) ABSTRACT

A selectively operable vacuum source is disclosed. In one example, vacuum source supplies as much air to an engine as is drawn by the vacuum source from a vacuum reservoir. The approach may provide vacuum to a vehicle vacuum system efficiently and with less weight than other vacuum sources.

16 Claims, 5 Drawing Sheets

METHOD AND SYSTEM FOR OPERATING AN EJECTOR

BACKGROUND/SUMMARY

Vacuum has long been used in vehicles to operate actuators and other devices. Vacuum has been and continues to be an attractive power source because it may be less expensive and more readily available as compared to other power sources. For example, vacuum may be available from the intake manifold of an internal engine or from a vacuum pump powered by the engine or an electrical power source such as a battery. However, as manufacturers strive to increase engine efficiency, vacuum from the engine intake manifold may be less available from the engine intake manifold since engines are being operated more often at higher intake manifold pressures so as to improve engine operating efficiency. By operating an engine at a higher intake manifold pressure, it may be possible for a small engine to produce the same amount of power as a larger engine. For example, air entering a four cylinder engine can be pressurized so that the four cylinder engine has output power similar to a six cylinder engine. In this way, the smaller engine may be more efficient than the larger engine since it may have less friction and fewer pumping losses than the larger engine. However, when an engine is operated at higher intake manifold pressures, less vacuum may be available to power vacuum operated actuators and devices.

Of course, vacuum may be also supplied to vacuum operated devices via a vacuum pump. However, vacuum pumps that have a capacity to source sufficient vacuum to operate a vehicle's brake system are often large and heavy. Further, some vacuum pumps require lubricating oil while some vacuum pumps expel oil mist when operated. Thus, vacuum pumps can have limitations that may be undesirable.

The inventors herein have recognized the above-mentioned disadvantages and have developed a system for providing vacuum for a vehicle, comprising: an ejector; an ejector pump configured to pump only air drawn through a low pressure region of the ejector; and an air conduit, the air conduit housing the ejector and at least a portion of the ejector pump, the air conduit having a sole air inlet and a sole air outlet.

By placing an ejector or a venturi within an air conduit that has a sole air inlet and a sole air outlet, it may be possible to generate vacuum for actuators and devices even during conditions of high intake manifold pressure. In particular, an ejector pump and/or a venturi pump can be configured to pump air without pump lubricating oil, excepting bearing lubrication which can be placed external to the air conduit so that oil may not enter the air conduit. Further still, since air can be directed from the pump outlet to the pump inlet, the pump may operate at a higher efficiency.

In addition, by placing the ejector or venturi output at a low pressure, such as along an intake air system, conditions are favorable for producing vacuum. Further, placing the blower that is in communication with an ejector or venturi in a low pressure environment is favorable for reducing blower energy consumption. Ejectors and venturi are devices that are inherently volume flow devices, not mass flow devices, thus lowering the density of the air does not lower the vacuum making potential.

The present description may provide several advantages. In particular, the approach can selectively provide vacuum based on vacuum consumption. Further, the approach may draw less air into the engine air intake system which bypasses the main air intake filter. Further still, approach may be realized with a light weight ejector or venturi pump. In addition, by using a blower instead of a vacuum pump the expense of sealing the pumping chambers of a vacuum pump are avoided. No conventional air seal is required in the blower configuration.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
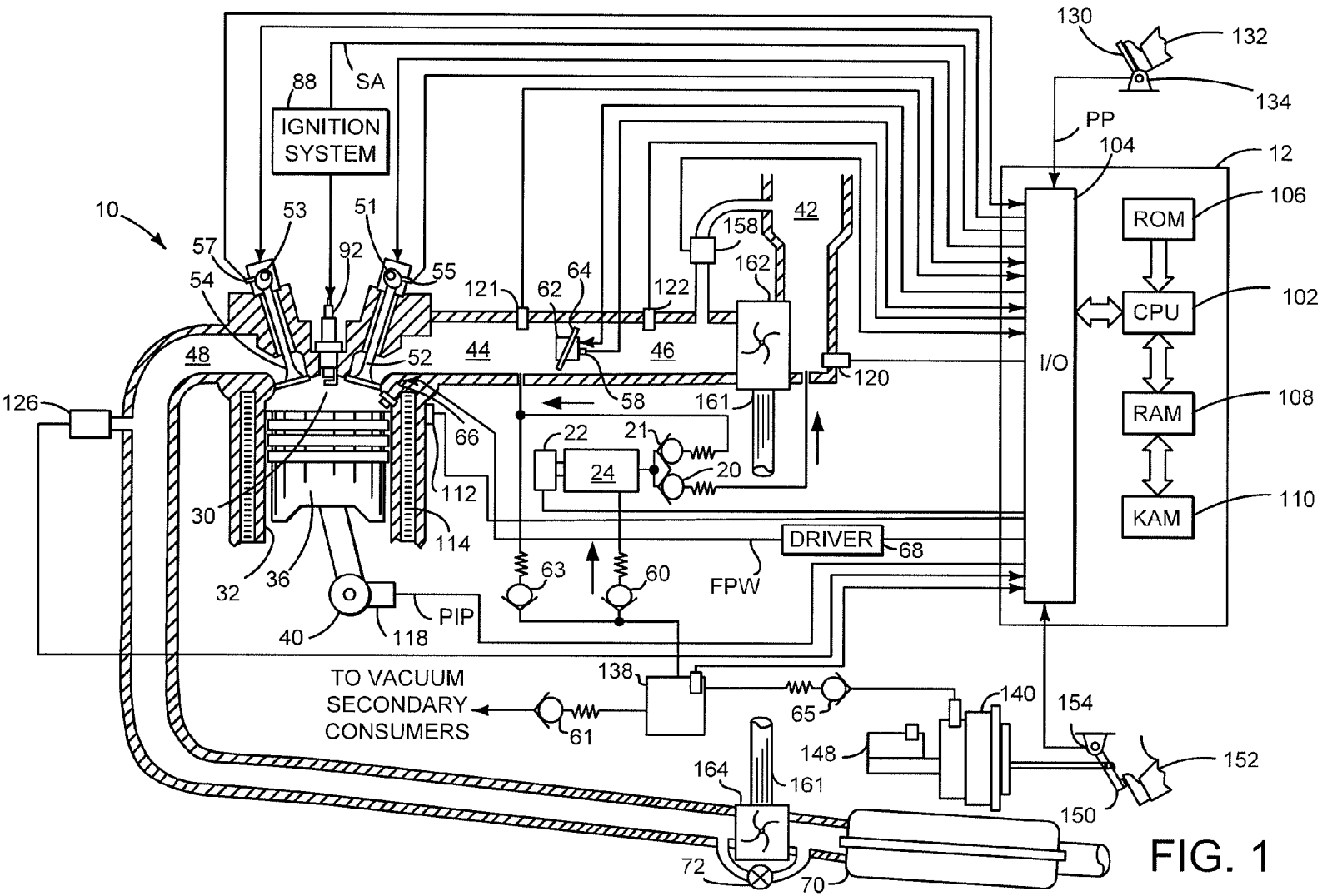
FIG. 1 shows a schematic depiction of an engine.
Figure 2:
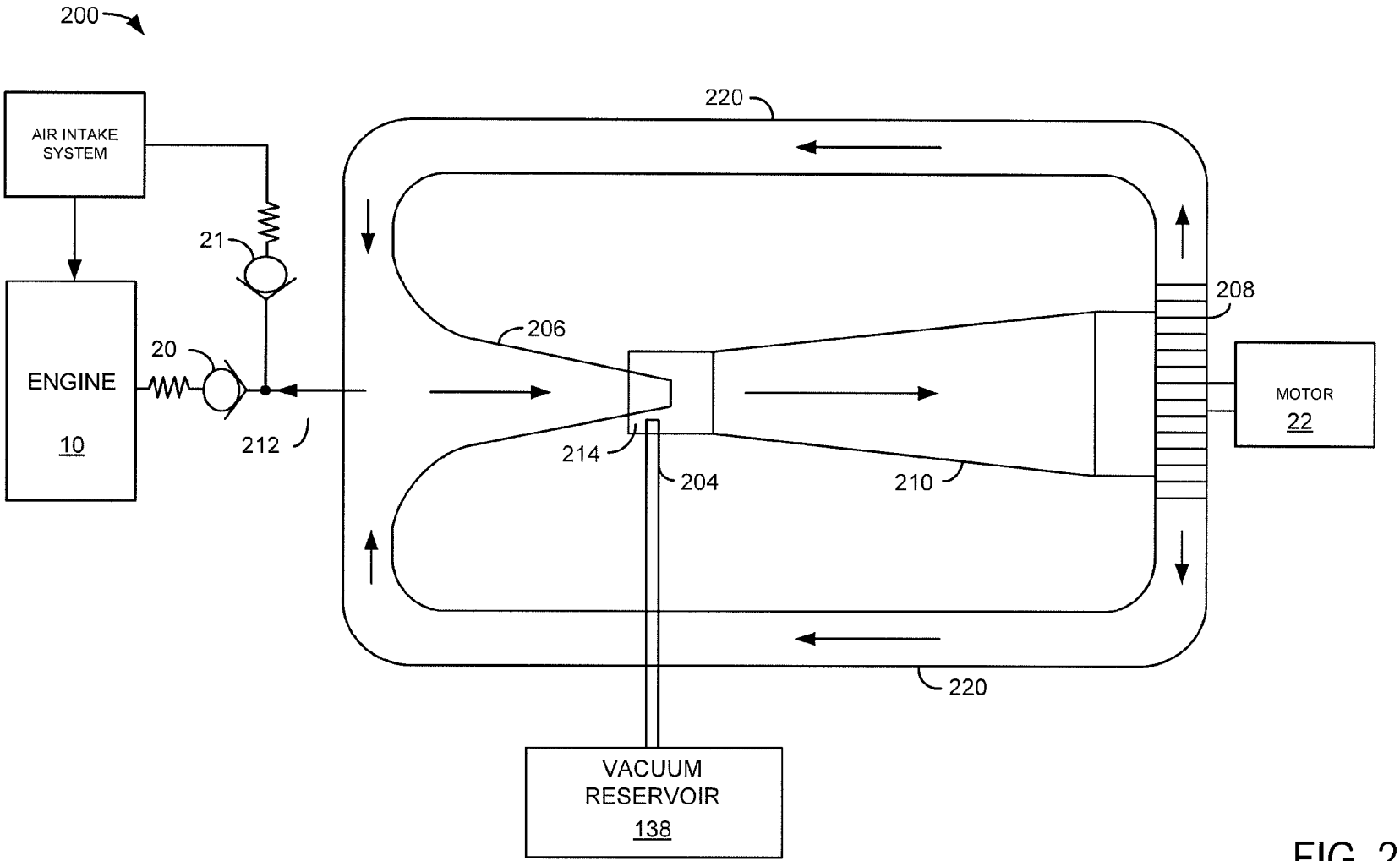
FIG. 2 show a schematic depiction of an air conduit.
Figure 3:
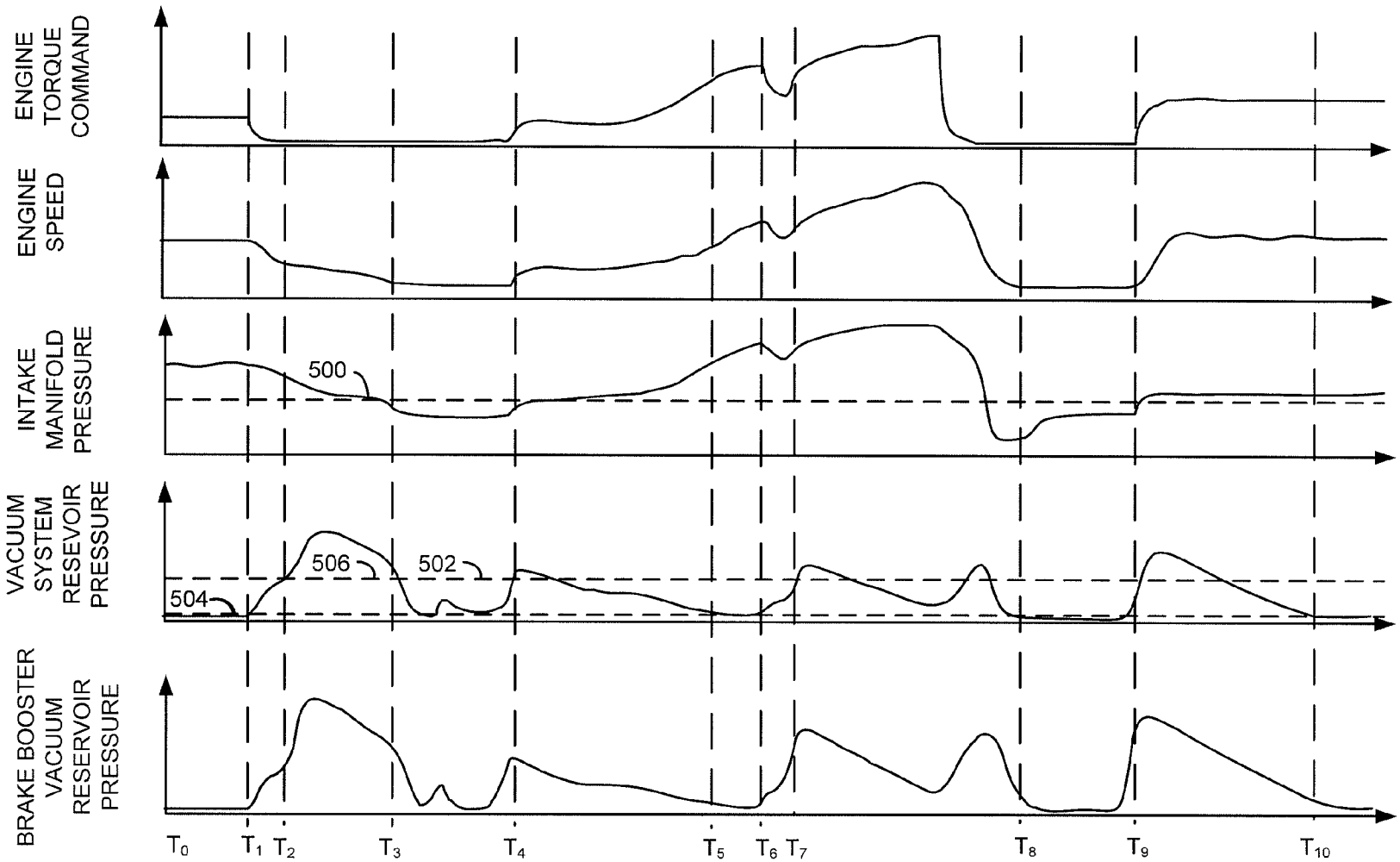
FIGS. 3-4 show simulated signals of interest during engine operation.
Figure 4:
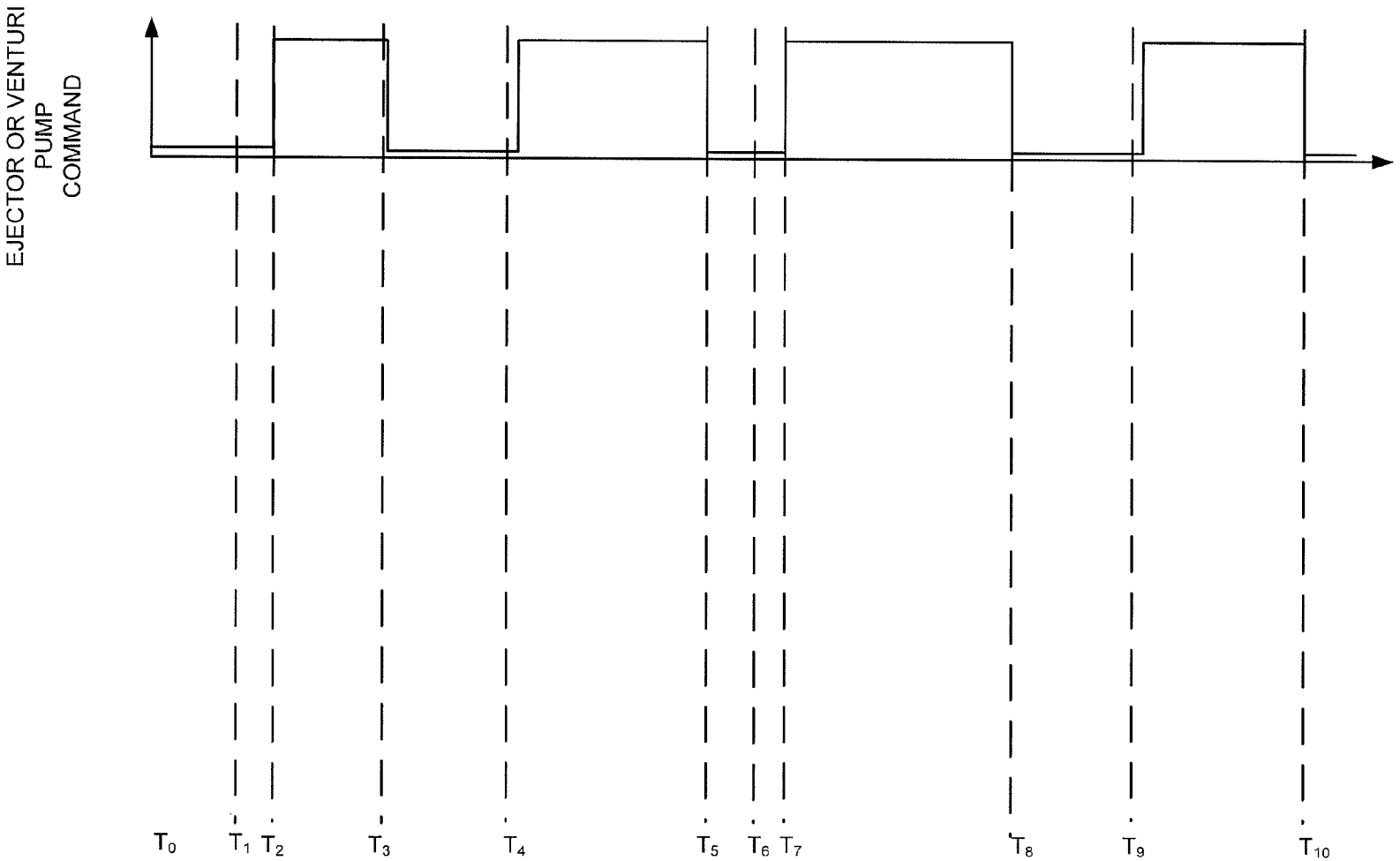
Figure 5:
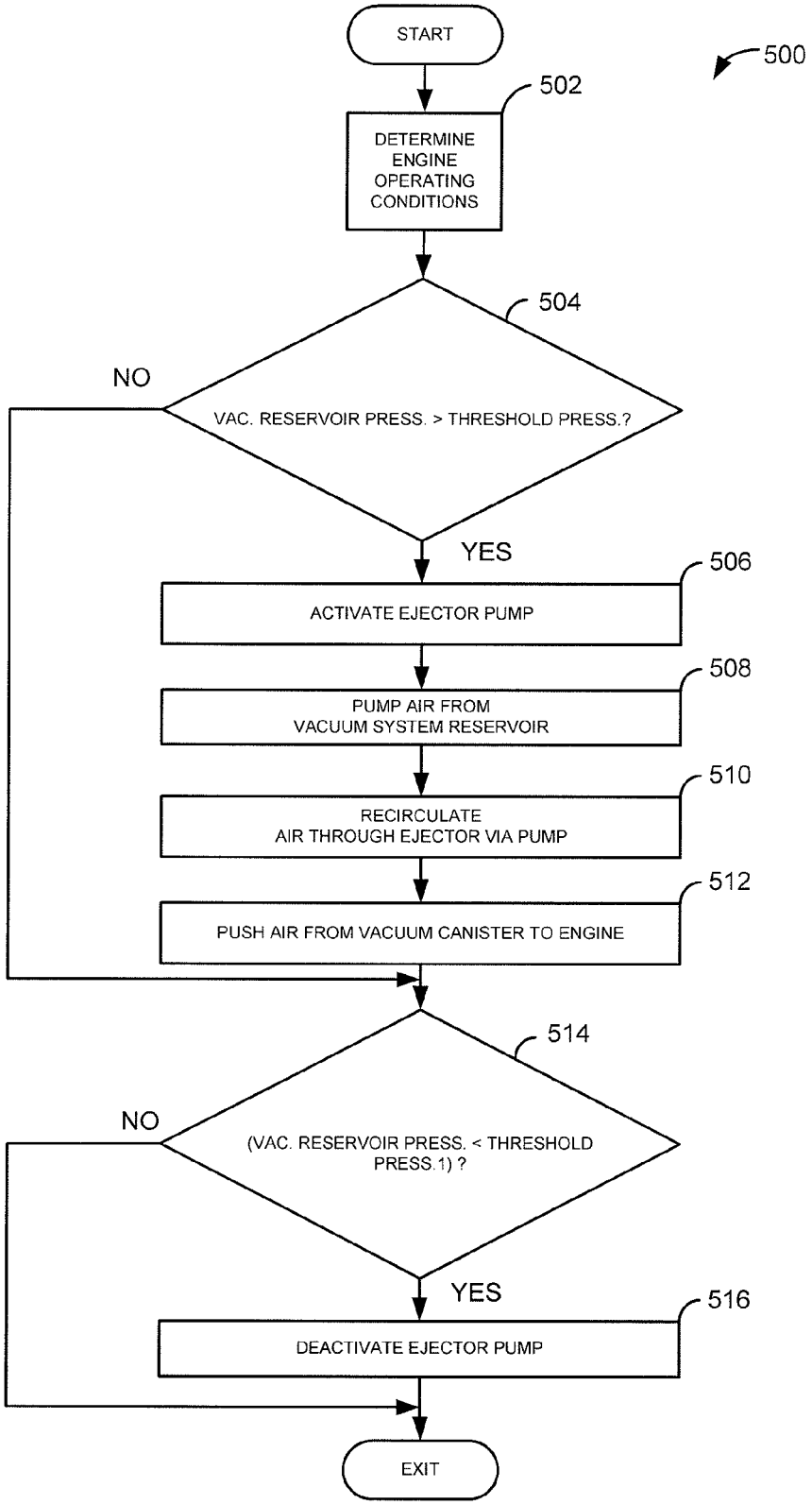
FIG. 5 shows a high level flowchart of a method for providing vacuum to a vacuum system of a vehicle.

The present description is related to providing vacuum to assists in actuator operation. FIG. 1 shows one example embodiment for providing vacuum to a vehicle vacuum system. FIG. 2 provides one example of an air conduit and ejector for providing vacuum. FIGS. 3 and 4 show simulated signals of interest when providing vacuum with an engine having a selectively operable ejector or venturi vacuum generating system. FIG. 5 shows a method for providing the vacuum and control as illustrated in FIGS. 3-4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46.

Compressor 162 draws air from air intake 42 to supply boost chamber 46. Exhaust gases spin turbine 164 which is coupled to compressor 162 via shaft 161. Compressor bypass valve 158 may be electrically operated via a signal from controller 12. Compressor bypass valve 158 allows pressurized air to be circulated back to the compressor inlet to limit boost pressure. Similarly, vacuum operated waste gate actuator 72 allows exhaust gases to bypass turbine 164 so that boost pressure can be controlled under varying operating conditions. Vacuum is supplied to waste gate actuator 72 via vacuum system reservoir 138. In some examples, vacuum system reservoir 138 may be referred to as a vacuum system reservoir since it can supply vacuum throughout the vacuum system and since brake booster 140 may contain a vacuum reservoir too. Vacuum system reservoir 138 may be supplied vacuum from intake manifold 44 via check valve 63. Check valve 63 allows air to flow from vacuum system reservoir 138 to intake manifold 44 and substantially prevents air flow from intake manifold 44 to vacuum system reservoir 138. Vacuum system reservoir 138 may also be supplied vacuum via air conduit 24. A low pressure region is created via connection through check valve 20 connecting to atmospheric pressure or check valve 21 connecting to intake manifold pressure. Air conduit 24 includes an ejector or a venturi. Ejector check valve 60 allows air to flow from vacuum system reservoir 138 to air conduit 24 and substantially prevents air flow from air conduit 24 to vacuum system reservoir 138. Ejector or venturi pump 22 is selectively operable and may be comprised of an electrically driven motor. Ejector or venturi pump 22 compresses air within an air conduit 24 supplying air to a converging ejector or venturi nozzle within air conduit 24. A low pressure region is created in air conduit 24 allowing air to flow from vacuum system reservoir 138 into air conduit 24. Air exits air conduit 24 and enters the engine air intake system at a location upstream of compressor 162 via check valve 20. Alternatively, air exits air conduit 24 and enters the engine air intake system at a location downstream of throttle 62. Check valves 20 and 21 allow air to flow from air conduit 24 to the engine air intake system and substantially prevent air flow from the engine intake system to air conduit 24. Vacuum system reservoir 138 provides vacuum to brake booster 140 via check valve 65. Check valve 65 allows air to enter vacuum system reservoir 138 from brake booster 140 and substantially prevents air from entering brake booster 140 from vacuum system reservoir 138. Vacuum system reservoir 138 may also provide vacuum to other vacuum consumers such as turbocharger waste gate actuators, heating and ventilation actuators, driveline actuators (e.g., four wheel drive actuators), fuel vapor purging systems, engine crankcase ventilation, and fuel system leak testing systems. Check valve 61 limits air flow from vacuum system reservoir 138 to secondary vacuum consumers (e.g., vacuum consumers other than the vehicle braking system). Brake booster 140 may include an internal vacuum reservoir, and it may amplify force provided by foot 152 via brake pedal 150 to master cylinder 148 for applying vehicle brakes (not shown).

Check valve 63 provides that the reservoir 138 pressure does not exceed the intake manifold pressure. In other words, check valve 63 provides fast pull down of reservoir pressure when a low intake manifold pressure is available. Check valve 60 allows flow when the pressure produced via the ejector within air conduit 24 is lower than the pressure within reservoir 138.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a position sensor 154 coupled to brake pedal 150 for sensing brake pedal position; a knock sensor for determining ignition of end gases (not shown); a measurement of engine manifold pressure (MAP) from pressure sensor 121 coupled to intake manifold 44; a measurement of boost pressure from pressure sensor 122 coupled to boost chamber 46; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Referring now to FIG. 2, a schematic depiction of an air conduit is shown. In the illustrated example, air may enter air conduit assembly 200 via a sole air inlet 204. In some examples, a check valve may be placed between air conduit assembly 200 and vacuum system reservoir 138 to substantially prevent air from flowing from air conduit assembly 200 to vacuum system reservoir 138. In the example of FIG. 2, an ejector is mechanically coupled to air conduit assembly 200. Thus, in some examples, the ejector may be included as part of air conduit assembly 200. The ejector is comprised of suction inlet or sole conduit air inlet 204, converging nozzle 206, and diffuser outlet 210. Alternatively, the ejector may be replaced by a venturi that operates in a similar manner as the ejector. Air is supplied to the converging nozzle 206 via conduits 220. Air is directed from diffuser outlet 210 by ejector or venturi pump 208. Ejector or venturi pump 208 is shown being driven via motor 22. Motor 22 may be electrically, mechanically, or hydraulically driven. In one example, motor 22 has a shaft that enters air conduit assembly 200 via a seal that limits leakage of air from conduit 200 to atmosphere. Of course, if motor 22 is within air conduit assembly 200, no dynamic seal is necessary. Air may exit air conduit assembly 200 via sole air outlet 212. Check valve 20 allows air to flow from air conduit to engine 10 when a relief pressure of check valve 20 is overcome via pressure from ejector or venturi pump 208. In other examples, a plurality of check valves may be positioned at the sole outlet of air conduit assembly 200 so that air may be directed to one or more locations. For example, one check valve may direct air to a location along the air intake of the engine while another check valve directs air to a location in the engine crankcase.

Thus, ejector or venturi pump circulates air through air conduit assembly 200 by drawing air from the diffuser outlet 210 and directing the air back to the ejector inlet at converging nozzle 206. The pressurized air accelerates through the nozzle and decreases in pressure. Further, the accelerated air exits the converging nozzle and creates a low pressure region 214 allowing air to flow into air conduit assembly 200 via suction inlet 204. By circulating air around air conduit 220, the efficiency of ejector or venturi pump 208 can be increased via recovered energy. As air enters air conduit assembly 200 via suction inlet 204, the outlet pressure of ejector or venturi pump can increase causing check valve 20 to open and allowing a substantially same amount of air to exit air conduit assembly 200 as is drawn into air conduit assembly 200 via suction inlet 204. In this way, vacuum is generated via air conduit assembly 200 and does not include inducting additional air beyond air displaced to create vacuum. Further, when sole air outlet 212 is coupled to the engine at a low pressure region (e.g., at the inlet of a turbocharger compressor), the efficiency of ejector or venturi pump 208 can be further increased. This is due to two reasons. First, ejectors produce better vacuum as the discharge pressure is lowered. Second, fans/compressors/blowers consume less energy as the air density decreases. As long as the same volumetric flow is maintained, the vacuum produced is unchanged at this lower density.

Thus, the systems of FIGS. 1 and 2, provide for a system for providing vacuum for a vehicle, comprising: an ejector; an ejector pump configured to pump only air drawn through a low pressure region of the ejector; and an air conduit, the air conduit housing the ejector and at least a portion of the ejector pump, the air conduit having a sole air inlet and a sole air outlet. The system includes where the sole air inlet is a suction inlet of the ejector and where the sole air outlet includes at least one check valve positioned to allow air to exit the air conduit and substantially prevent air flow entering into the air conduit. The system also includes where the ejector pump is configured to pump an amount of air out of the sole air outlet that is substantially equivalent to an amount of air drawn through the sole air inlet. In this way, the amount of air drawn from the vacuum system reservoir via the ejector or venturi can reduce the amount of air filtered by the engine as compared to a blower-ejector system that does not circulate the motive fluid (air). In some examples, the system includes where the ejector pump is an electrically motivated pump. The system further includes where the sole air outlet is configured to exhaust air from the air conduit when a relief pressure of the at least one check valve is overcome via a pressure from the ejector pump. The relief valve can substantially limit air flow from the engine intake manifold to the vacuum system reservoir. The system also includes where an inlet to the ejector pump and an outlet of the ejector pump are sealed within the air conduit. The system includes where the air conduit is configured to route air exiting an outlet of the ejector pump to an inlet of the ejector and to route air exiting an outlet of the ejector to an inlet of the ejector pump.

The systems of FIGS. 1 and 2 also provide for vacuum system for a vehicle, comprising: an ejector or a venturi; an ejector pump or a venturi pump; an air conduit, the air conduit housing the ejector or the venturi and at least a portion of the ejector pump, the air conduit having a sole air inlet and a sole air outlet; and an engine configured to accept air output from the sole air outlet in an intake air passage. The system also includes where the engine is configured to accept air output from the air conduit to a first location in an air intake of the engine downstream of an air inlet throttle. In one example, the system includes where the engine is further configured to accept air from the air conduit at a second location upstream of a compressor input, and where the air inlet throttle is located downstream of a compressor output. By outputting air from the air conduit to the engine, the efficiency of the ejector pump may be increased. In one example, the system further comprises a first check valve and a second check valve, the first check valve configured to limit air flow from an intake manifold of the engine, the second check valve configured to limit air flow from upstream of the compressor input. In this way, the device always exhausts to the lowest available air pressure.

The system further comprises a vacuum reservoir, the vacuum reservoir configured to supply air to the air conduit. In some examples, the system further comprises a controller, the controller including instructions for selectively operating the ejector pump or the venturi pump in response to a condition of the vacuum reservoir. Thus, operation of the ejector pump may be limited to conditions where operation of the ejector pump is more efficient. The system further comprises instructions for selectively operating the ejector pump or venturi pump responsive to a condition of an intake manifold of the engine. The system further comprises instructions for adjusting the condition of the vacuum reservoir in response to barometric pressure. The system further comprises a controller, the controller including instructions for selectively operating the ejector pump or venturi pump in response to a condition of a brake pedal.

It should also be noted that the system of FIG. 2 can be applied to fuel vapor purge systems. In particular, the suction inlet 204 of air conduit assembly 200 can be coupled to and in fluidic communication with a fuel vapor storage canister via a conduit and valves. The sole air outlet 212 can be coupled to the engine as shown in FIG. 2. The ejector pump 208 is operated when an amount of fuel vapors stored in the fuel vapor storage canister exceed a threshold amount. In one example, the air conduit may include a fuel vapor storage medium (e.g., activated charcoal) such that the air conduit acts as a fuel vapor storage device and a vacuum generator. With such a system, the amount of air entering the engine is substantially equivalent to the amount of air entering the air conduit via the fuel vapor storage system. Thus, lower flow rates of higher concentration fuel vapors may be directed to the engine. Consequently, engine air-fuel control may be improved along with fuel economy since the engine may operate with fewer lean or rich air-fuel excursions.

Referring now to FIGS. 3 and 4, simulated signals of interest during engine operation are shown. Similar signals may be produced according to the method of FIG. 5 with the system of FIG. 1. FIG. 3 includes five plots and FIG. 4 includes a single plot. The signals are referenced to vertical markers $T_0$-$T_{11}$ that represent same times in each plot, and the sequences of FIGS. 3 and 4 occur at the same time and are related. Accordingly, FIG. 4 is explained with FIG. 3 below. It should also be noted that the units between plots may be different. For example, a pressure in the intake manifold may appear at a same level as a vacuum reservoir pressure, however, the two pressures may be substantially different. Thus, the signals in FIGS. 3 and 4 provide directional information rather than absolute data.

The first plot from the top of FIG. 3 shows an engine torque command versus time. Engine torque increases in the direction of the Y axis arrow. The X axis represents time, and time increases from the left to the right of the plot.

The second plot from the top of FIG. 3 shows engine speed versus time. Engine speed increases in the direction of the Y axis arrow. The X axis represents time, and time increases from the left to the right of the plot.

The third plot from the top of FIG. 3 shows engine intake manifold pressure versus time. Engine intake manifold pressure increases in the direction of the Y axis arrow. The X axis represents time, and time increases from the left to the right of the plot. Thus, the intake manifold is at a higher vacuum level when the engine intake manifold pressure is low. FIG. 3 also includes horizontal line 500 that represents atmospheric pressure. Thus, the engine intake manifold holds a positive pressure when engine intake manifold pressure is above line 500. On the other hand, the engine intake manifold holds a negative pressure or vacuum when the engine intake manifold pressure is below line 500.

The fourth plot from the top of FIG. 3 shows secondary vacuum reservoir pressure versus time. Vacuum system reservoir pressure increases in the direction of the Y axis arrow. The X axis represents time, and time increases from the left to the right side of the plot. FIG. 4 also includes two horizontal lines 502 and 504 that represent two threshold vacuum reservoir pressures. Line 504 represents a low pressure or high vacuum threshold whereby it may be desirable to deactivate the ejector or venturi pump. Line 502 represents a vacuum threshold whereby it may be desirable to activate the ejector or venturi pump. Thus, the ejector or venturi pump can be activated at a first pressure and deactivated at a second pressure.

The fifth plot from the top of FIG. 3 shows brake booster vacuum reservoir pressure versus time. Brake booster vacuum reservoir pressure increases in the direction of the Y axis arrow. The X axis represents time, and time increases from the left to the right side of the plot.

Referring now to FIG. 4, the first plot from the top of FIG. 4 shows an ejection or venturi pump command. The pump is commanded on when the signal is near the top of the plot. The pump is commanded off when the signal is near the bottom of the plot. Further, it should be mentioned that the pump may be operated at different speeds to provide different rates and amount of vacuum if desired.

At time $T_0$, the engine torque command is at a middle level as is the engine speed. The engine and vehicle may be cruising during similar conditions. Engine intake manifold pressure is also elevated to a positive pressure. Consequently, the engine intake manifold cannot supply vacuum to the vacuum system reservoir at time $T_0$. However, pressure in the vacuum system reservoir is low at time $T_0$. Therefore, additional vacuum is not needed at the secondary vacuum reservoir at time $T_0$. Further, pressure in the brake booster vacuum reservoir is low at time $T_0$ so additional vacuum is not needed at time $T_0$. Consequently, since there is a desirable level of vacuum in the consumer vacuum reservoir, the ejector or venturi pump is commanded off as indicated by the low level signal at $T_0$ of FIG. 4.

At time $T_1$, the engine torque command decreases and engine speed also starts to decrease as less torque is available to keep the engine at an elevated speed. Engine intake manifold pressure also decreases since the engine torque can be provided with less air to meet the engine torque command. Pressure in the brake booster also increases when the brake is applied to slow the vehicle, for example. Since the brake booster pressure increases above the vacuum system reservoir pressure, a pressure difference is created between the brake booster and the vacuum system reservoir that allows air to flow from the vacuum reservoir to the vacuum system reservoir. The pressure in the vacuum system reservoir may lag the pressure in the brake booster vacuum reservoir and the two pressures may during transient conditions since the reservoirs are linked via a conduit. The ejector pump remains off at time $T_1$ since pressure in the vacuum system reservoir is less than pressure threshold 502.

At time $T_2$, the engine torque command remains low and the engine speed continues to fall. The intake manifold pressure also has decreased but remains above atmospheric pressure. Pressure in the vacuum system reservoir has reached pressure threshold 502 which causes the controller to activate the ejector or venturi pump as indicated in FIG. 4. Pressure also continues to increase in the brake booster vacuum reservoir in response to a release of the brakes, for example. Air can enter the brake booster vacuum reservoir during application and release of vehicle brakes. A larger quantity of air may enter the brake booster vacuum reservoir when the brake pedal is released as compared to when the brake pedal is applied since air at atmospheric pressure may be used to assist in the application of vehicle brakes.

Between time $T_2$ and $T_3$, the engine torque command stays low and the engine speed begins to approach idle speed. In addition, intake manifold pressure continues to decrease and goes from a positive pressure to a negative pressure near time $T_3$. Pressure in the vacuum system reservoir peaks in response to air drawn into the vacuum system reservoir from the brake booster vacuum reservoir, and then, pressure starts to decrease in the vacuum system reservoir as air is drawn from the vacuum system reservoir into the ejector or venturi. Consequently, pressure in the brake booster also starts to decrease after peaking when air is drawn from the brake booster vacuum reservoir into the vacuum system reservoir. The ejector or venturi pump remains on between time $T_2$ and $T_3$.

At time $T_3$, the engine torque command is low and the engine speed reaches idle speed. The intake manifold pressure also falls to a pressure less than atmospheric pressure so that air can be drawn into the engine intake manifold when pressure in the engine intake manifold is less than pressure in the vacuum system reservoir. A check valve (e.g., check valves 20 and 21) between the engine intake manifold and the vacuum system reservoir substantially prevents air flow from the engine intake manifold to the vacuum system reservoir and the check valve allows air flow from the vacuum system reservoir to the engine intake manifold. Pressure in the vacuum system reservoir decreases quickly after time $T_3$ at a time when the engine intake manifold pressure is less than vacuum system reservoir pressure. Pressure in the brake booster vacuum reservoir also decreases as air is drawn from the brake booster vacuum reservoir to the vacuum system reservoir. The ejector or venturi pump is deactivated when pressure in the vacuum system reservoir reaches pressure threshold 504. Thus, near time $T_3$, the intake manifold assists the ejector or venturi to remove air from the vacuum system reservoir.

Between time $T_3$ and $T_4$, the engine torque command is low and the engine is at idle speed. The intake manifold pressure is also below atmospheric pressure. Brake booster vacuum reservoir pressure and vacuum system reservoir pressure briefly increase as the brake pedal is depressed. Air that is released into the brake booster vacuum reservoir is quickly removed as the air flows into the engine intake manifold via the vacuum system reservoir. Shortly before time $T_4$, the brake pedal is released and pressure in the brake booster vacuum reservoir and in the vacuum system reservoir increase. However, the pressure rise in the vacuum system reservoir lags the pressure rise in the brake booster vacuum reservoir.

At time $T_4$, the engine torque command increases followed shortly thereafter by an increase in engine speed. Intake manifold pressure is also increased so that the engine air amount can be increased to provide the commanded engine torque. Pressure in the vacuum system reservoir increases to a level above pressure threshold 502 causing the controller to reactivate the ejector or venturi pump as indicated by the high level ejector pump command signal in FIG. 4. The ejector or venturi begins to draw air from the vacuum system reservoir and pumps it into the engine at a location upstream of a turbocharger so that air enters the engine where pressure in the engine air intake system at a pressure tap is lowest. Pressure in the vacuum system reservoir decreases until it is less than pressure threshold 504. The ejector or venturi pump is deactivated in response to pressure in the vacuum system less than pressure threshold 504 at time $T_5$.

At time $T_6$, the engine torque demand is reduced and the engine speed is also reduced since less engine torque is available to rotate the engine. Intake manifold pressure is also reduced; however, intake manifold pressure remains above atmospheric pressure. The decrease in engine torque and speed may be representative of a vehicle coasting condition. In addition, the brake pedal is applied, but pressure in the vacuum system reservoir remains below pressure threshold 502. Therefore, the controller does not reactivate the ejector or venturi pump as indicated by the low level pump command at time $T_6$ of FIG. 4.

Just before time $T_7$, the brake pedal is released and the engine torque command is increased shortly thereafter. Pressure in the brake booster vacuum reservoir increases above pressure threshold 502 in response to releasing the brake pedal. Consequently, the controller reactivates the ejector or venturi pump. Engine torque and engine speed are also increased after time $T_7$ to accelerate the vehicle, for example. Intake manifold pressure also increases as engine cylinder air charge is increased to meet the increased engine torque command.

Pressure in the vacuum system reservoir and the brake booster vacuum reservoir are gradually pumped down by the ejector or venturi until time $T_8$ where the brake pedal is reapplied and pressure in the brake booster vacuum reservoir increases. As a result, the ejector or venturi pump remains activated. Shortly after time $T_8$, engine intake manifold pressure decreases below atmospheric pressure and consequently air is drawn from the vacuum system reservoir into the engine intake manifold. The intake manifold and the ejector or venturi pump combine to draw air from the brake booster vacuum reservoir and the vacuum system reservoir until pressure in the vacuum system reservoir reaches pressure threshold 504 shortly after time $T_8$. The ejector or venturi pump is deactivated when pressure in the vacuum system reservoir reaches pressure threshold 504.

Shortly before time $T_9$, the brake pedal is released and the engine torque demand is increased to accelerate the vehicle, for example. Releasing the brake causes pressure to rise in the brake booster reservoir and in the vacuum system reservoir. Pressure in the vacuum system reservoir increases to a level greater than pressure level threshold 502. Consequently, the ejector or venturi pump is reactivated and pressure in the vacuum system reservoir and the brake booster vacuum reservoir is lowered as air is drawn into the ejector or venturi.

At time $T_{10}$, pressure in the vacuum system reservoir reaches pressure threshold 504 and the controller deactivates the ejector or venturi pump in response to the pressure in the vacuum system reservoir. The engine torque and engine speed are at an elevated level as is the intake manifold pressure. As a result, the ejector or venturi pump is the sole device that reduces pressure in the vacuum system reservoir and the brake booster vacuum reservoir.

Thus, it can be seen from FIGS. 3 and 4 that the ejector or venturi pump can be selectively activated and deactivated in response to a pressure in the vacuum system. Further, in some examples, a timer can be activated and incremented when the ejector or vacuum pump is activated. The control strategy may require that the vacuum pump be activated for a minimum time period to reduce cycling of the vacuum pump. In addition, when the ejector or venturi is configured as is shown in FIG. 2, the engine inducts only the amount of air removed from the vacuum reservoirs. And, the ejector or venturi pump efficiency may be improved since the ejector or venturi pump is in communication with a lower pressure region of the engine intake system.

Referring now to FIG. 5, method 500 is executable as instructions of a controller such as illustrated in FIG. 1 with an ejector illustrated in FIG. 2. Further, method 500 may provide signals similar to those illustrated in FIGS. 2 and 3.

At 502, method 500 determines engine operating conditions. Engine operating conditions may include but are not limited to engine temperature, brake booster vacuum reservoir pressure, vacuum system reservoir pressure, ambient pressure and temperature, engine speed, engine intake manifold pressure, and engine torque. Method 500 proceeds to 504 after engine operating conditions are determined.

At 504, method 500 judges whether or not vacuum system reservoir pressure is greater than a threshold pressure. In some examples, the threshold pressure may be adjusted to account for barometric pressure. For example, if barometric pressure decreases the threshold pressure may be decreased so that a desired pressure differential exists between atmospheric pressure and pressure in the vacuum system reservoir. Consequently, the pressure at which the ejector pump is activated may be adjusted for changes in barometric pressure.

If vacuum system reservoir pressure is greater than a threshold pressure, method 500 activates a timer, begins to accumulate time, and proceeds to 506. Otherwise, method 500 moves to 514. In other examples, method 500 may also require that intake manifold pressure be greater than atmospheric pressure to activate the ejector or venturi pump so that pump operation may be reduced an so that vacuum in the intake manifold provides vacuum to the vacuum system. Thus, method 500 allows pressure to be drawn from the vacuum system reservoir via the intake manifold without activating the ejector or venturi pump when engine intake manifold pressure is low. In addition, method 500 may activate the ejector or venturi pump at a first threshold pressure and deactivate the ejector of venturi pump at a second threshold pressure. As such, the ejector or venturi pump may cycle on and off less often.

At 506, method 500 activates the ejector or venturi pump. In one example, the ejector or venturi pump may be electrically motivated. In other examples, the ejector or venturi pump may be mechanically driven and engaged and disengaged via a clutch. Method 500 proceeds to 508 after activating the ejector or venturi pump.

At 508, method 500 pumps air from the vacuum system reservoir. In one example, air is pumped from a vacuum system reservoir 138 as shown in FIG. 1 via an air conduit and ejector pump as illustrated in FIG. 2. Method 500 proceeds to 510 when air is pumped from the vacuum system reservoir.

At 510, method 500 re-circulates air through an ejector via a pump as described in FIG. 2. In particular, air is drawn into an air conduit via a sole air inlet of the ejector. A low pressure region is created in the ejector by compressing and accelerating air through a converging nozzle of the ejector. The air that is drawn into the ejector is expanded as it passes from a suction input to a diffuser outlet. An ejector pump re-circulates at least a portion of the air drawn into the suction inlet to the converging nozzle. Further, the ejector pump re-circulates air that has already passed through the converging inlet nozzle. Method 500 proceeds to 512 after re-circulating at least a portion of air in the ejector.

At 512, method 500 pushes air from the vacuum system reservoir to the engine. Since the air conduit of FIG. 2 has only a sole air inlet and a sole air outlet, substantially the same amount of air that is drawn into the air conduit via the air inlet exits the air conduit via a sole air outlet. Air proceeds to the engine air intake system or the engine crankcase and check valves substantially prevent air from flowing from the engine intake system or crankcase to the vacuum system reservoir. Method 500 proceeds to 514 after air begins flowing to the engine.

At 514, method 500 judges whether or not vacuum system reservoir pressure is less than a threshold pressure. Further, in some examples, method 500 judges whether or not engine intake manifold pressure is less than atmospheric pressure minus a pressure offset and that the ejector pump has been operating for a predetermined amount of time. If vacuum reservoir pressure is less than a threshold pressure, method 500 proceeds to 516. Otherwise, method 500 proceeds to exit. It should be noted that in some examples, the threshold pressure may be adjusted to account for barometric pressure. Consequently, the pressure at which the ejector pump is deactivated may be adjusted for changes in barometric pressure. For example, if barometric pressure decreases the pressure at which the ejector pump is deactivated may be increased.

At 516, method 500 deactivates the ejector pump. The ejector pump may be deactivated by decoupling mechanical or electrical power sources from the ejector pump. Method 500 proceeds to exit after deactivating the ejector pump.

Thus, the method of FIG. 5 provides for producing vacuum for a vehicle, comprising: drawing an amount of air from a vacuum reservoir via a low pressure region of an ejector or venturi into an air conduit having a sole air inlet and a sole air outlet; providing at least a portion of the amount of air from the vacuum reservoir to a converting nozzle of the ejector or venturi; and providing an amount of air to an engine via the sole air outlet, the amount of air provided to the engine substantially equivalent to the amount of air drawn from the vacuum reservoir. In one example, the method includes where an ejector pump or venturi pump is selectively operated in response to an operating condition of a vacuum system. The method also includes where operating condition is a pressure of a vacuum reservoir, and where at least a portion of the ejector pump is sealed within the air conduit. Further, the method includes where the amount of air provided to the engine is provided to a first or a second location along an air intake system of the engine depending on a pressure at the first location and a pressure at the second location.

As will be appreciated by one of ordinary skill in the art, the methods described in FIG. 5 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. In addition, the terms aspirator or venturi may be substituted for ejector since the devices may perform in a similar manner.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A system for providing vacuum for a vehicle, comprising:

an ejector;

an ejector pump configured to pump only air drawn through a low pressure region of the ejector; and an air conduit, the air conduit housing the ejector and at least a portion of the ejector pump, the air conduit having a sole air inlet and a sole air outlet.

2. The system of claim 1, where the sole air inlet is a suction inlet of the ejector and where the sole air outlet includes at least one check valve positioned to allow air to exit the air conduit and substantially prevent air flow entering into the air conduit.

3. The system of claim 2, where the ejector pump is configured to pump an amount of air out of the sole air outlet that is substantially equivalent to an amount of air drawn through the sole air inlet.

4. The system of claim 1, where the ejector pump is driven via an electric motor, and where the ejector is in fluidic communication with a fuel vapor storage system.

5. The system of claim 2, where the sole air outlet is configured to exhaust air from the air conduit when a relief pressure of the at least one check valve is overcome via a pressure from the ejector pump.

6. The system of claim 1, where an inlet to the ejector pump and an outlet of the ejector pump are sealed within the air conduit.

7. The system of claim 2, where the air conduit is configured to route air exiting an outlet of the ejector pump to an inlet of the ejector and to route air exiting an outlet of the ejector to an inlet of the ejector pump.

8. A system for providing vacuum for a vehicle, comprising:

an ejector or a venturi;

an ejector pump or a venturi pump;

an air conduit, the air conduit housing the ejector or the venturi and at least a portion of the ejector pump, the air conduit having a total of exactly one inlet comprising a sole air inlet and a total of exactly one outlet comprising a sole air outlet; and an engine configured to accept air output from the sole air outlet in an intake air passage.

9. The system of claim 8, where the engine is configured to accept air output from the air conduit to a first location in an air intake of the engine downstream of an air inlet throttle.

10. The system of claim 9, where the engine is further configured to accept air output from the air conduit at a second location upstream of a compressor input, and where the air inlet throttle is located downstream of a compressor output.

11. The system of claim 10, further comprising a first check valve and a second check valve, the first check valve configured to limit air flow from an intake manifold of the engine, the second check valve configured to limit air flow from upstream of the compressor input.

12. The system of claim 8, further comprising a vacuum reservoir, the vacuum reservoir configured to supply air to the air conduit.

13. The system of claim 12, further comprising a controller, the controller including instructions for selectively operating the ejector pump or the venturi pump in response to a condition of the vacuum reservoir.

14. The system of claim 13, further comprising instructions for selectively operating the ejector pump or venturi pump responsive to a condition of an intake manifold of the engine.

15. The system of claim 13, further comprising instructions for adjusting the condition of the vacuum reservoir in response to barometric pressure.

16. The system of claim 8, further comprising a controller, the controller including instructions for selectively operating the ejector pump or venturi pump in response to a condition of a brake pedal.

* * * * *